United States Patent [19]

Yoshioka et al.

[11] Patent Number: 4,533,434

[45] Date of Patent: Aug. 6, 1985

[54] PROCESS FOR SIZING PAPER AND PROCESS FOR MAKING PLASTERBOARD BASE PAPER SIZED THEREBY

[75] Inventors: Shigehiko Yoshioka; Hideto Yamada; Kimihiko Goto; Yoshio Adachi; Kazuo Miyahana, all of hyogo, Japan

[73] Assignee: Seiko Kagaku Kogyo Co., Ltd., Japan

[21] Appl. No.: 415,585

[22] Filed: Sep. 7, 1982

[30] Foreign Application Priority Data

Sep. 11, 1981 [JP] Japan ..... 56-143318
Sep. 11, 1981 [JP] Japan ..... 56-143320

[51] Int. Cl.[3] ..... D21H 1/02

[52] U.S. Cl. ..... 162/124; 156/39; 156/41; 162/128; 162/135; 162/158; 162/168.3; 428/537.5; 428/703

[58] Field of Search ..... 162/158, 124, 128, 168.3, 162/179, 135; 156/39, 41; 428/537.5, 703

[56] References Cited

U.S. PATENT DOCUMENTS 3,445,330 5/1969 Kulick et al. ..... 162/179
4,040,900 8/1977 Mazzerella et al. ..... 162/158
4,207,142 6/1980 Shepherd ..... 162/158
4,372,814 2/1983 Johnstone ..... 162/158

FOREIGN PATENT DOCUMENTS 1948994 4/1971 Fed. Rep. of Germany ... 162/168.3
46111 4/1977 Japan ..... 162/158
39082 10/1977 Japan ..... 162/168.3

*Primary Examiner*—Peter Chin
*Attorney, Agent, or Firm*—Andrus, Sceales, Starke & Sawall

[57] ABSTRACT

An improved sizing is feasible by adding into a papermaking pulp slurry an aqueous dispersion prepared by mixing an aqueous solution of an ampholytic acrylamide polymer having both cationic and anionic groups with a liquid substituted succinic anhydride or with an anhydrous liquid mixture of a liquid substituted succinic anhydride and an oil-in-water type surfactant. Such a paper sizing process is very useful for making plasterboard base paper of multilayered structure composed of at least one surface layer having a high hot water resistance and at least one back layer having a good adhesiveness to plaster slush.

14 Claims, No Drawings

PROCESS FOR SIZING PAPER AND PROCESS FOR MAKING PLASTERBOARD BASE PAPER SIZED THEREBY

The present invention relates to a process for sizing paper using a substituted succinic anhydride as a sizing agent, which can be easily operated on an industrial scale and which can provide improvedly sized paper. More particularly, the present invention relates to such a process for sizing paper which can impart a hot water penetration resistance to the resultant paper and further it relates to a process for making plasterboard base paper sized thereby.

There is known a process for sizing paper employing as a sizing agent an aqueous dispersion of a substituted succinic anhydride. For example, U.S. Pat. No. 3,102,064 discloses sizing paper with an aqueous dispersion prepared by dispersing an alkyl-substituted or alkenyl-substituted succinic anhydride in water with the aid of a cationic starch. It further discloses a process for sizing paper in which an aqueous dispersion prepared by dispersing said substituted succinic anhydride in water with the aid of a selected surfactant, for example a nonionic surfactant such as polyoxyethylene sorbitan trioleate or polyoxyethylene sorbitol hexaoleate, is used in combination with a cationic agent.

However, in the aforementioned paper sizing process of the prior art, the cationic starch must be cooked in use. In addition, such a dispersing agent or surfactant cannot secure a sufficient dispersibility of the substituted succinic anhydride in water, and the resultant aqueous dispersion of the substituted succinic anhydride loses its sizing effect rapidly with the lapse of time after preparation.

Accordingly, an object of the present invention is to solve the drawbacks of such prior art processes by providing an improved process for sizing paper comprising:

(i) feeding into a mixer continuously and at a constant metered rate (a) an aqueous solution of an ampholytic acrylamide polymer having both cationic and anionic groups, (b) a liquid substituted succinic anhydride or an anhydrous liquid mixture of a liquid substituted succinic anhydride and an oil-in-water type surfactant and, as required, (c) water; and (ii) adding the resultant aqueous dispersion into a papermaking pulp slurry continuously and at a constant metered rate immediately after the same is prepared in said mixer.

The ampholytic acrylamide polymers having both cationic and anionic groups used according to the present invention act to disperse in water a substituted succinic anhydride constituting a sizing ingredient. Such ampholytic polymers include water-soluble or water-dispersible copolymers having both cationic and anionic groups and structured of main repeating structural units comprising acrylamide and/or methacrylamide. Among those, it is desired to use such polymers having a molecular weight ranging from about 50,000 to about 1,000,000 and containing about 2 to about 80 percent or, more preferably, about 3 to 50 percent by mol of cationic groups and about 3 to about 20 percent or, more preferably, about 5 to 15 percent by mol of anionic groups, because these selected polymers are more effective to disperse the substituted succinic anhydride, namely, sizing agent. The cationic groups had by such ampholytic acrylamide polymers include primary, secondary and tertiary amino groups and quaternary ammonium groups. These groups may exist singly or in combination in such polymers.

While, the anionic groups herein referred to include carboxyl, sulfonic and phosphoric groups.

There are no particular limitations on the processes for producing the ampholytic acrylamide polymers used according to the present invention. For example, acrylamide, methacrylamide or their mixture may be subjected to copolymerization with cationic and anionic monomers and, as required, other comonomers. In another method, polyacrylamide, polymethacrylamide or a mixture of such polymers may be modified so that cationic and anionic groups are introduced therein. Alternatively, a copolymer composed of acrylamide, methacrylamide or their mixture and an anionic monomer or other comonomers or their mixture may be modified so as to introduce anionic and cationic groups therein. As the cationic monomers herein referred to, usable are aminoalkyl esters, monoalkylaminoalkyl esters or dialkylaminoalkyl esters of acrylic acid or methacrylic acid, their quaternary ammonium salts, monoalkylaminoalkyl acrylamides or methacrylamides, dialkylaminoalkyl acrylamides or methacrylamides, vinylpyridine, vinyl imidazole, allylamine or diallylamine. While, as the anionic monomers herein referred to, acrylic acid, methacrylic acid, maleic acid, itaconic acid, crotonic acid, vinylsulfonic acid, sulfonated styrene, or phosphates of hydroxyalkyl acrylates or methacrylates are usable. As the aforesaid other comonomers, usable are vinyl esters such as vinyl acetate and vinyl propionate, methyl vinyl ether, styrene or its derivatives, alkyl esters of acrylic acid or methacrylic acid, acrylonitrile, methacrylonitrile and so forth.

The acrylamide copolymers used according to the present invention may contain up to about 40 percent by mol of such other comonomer or comonomers.

In the aforementioned second or third methods of producing the ampholytic acrylamide polymers, the polyacrylamide, polymethacrylamide or their mixture or the copolymer composed of acrylamide, methacrylamide or their mixture and the anionic monomer or other comonomer or their mixture may be conveniently subjected to Hofmann degradation or to Mannich reaction for introducing cationic and anionic groups therein.

The substituted succinic anhydrides used according to the present invention are those substituted succinic anhydrides which contain alkyl groups, alkenyl, aralkyl or aralkenyl groups each having at least 5 carbon atoms, and per se are waterinsoluble by nature. Typically, they are alkenyl succinic anhydrides produced by addition reaction of maleic anhydride and $\alpha$-olefins, inner olefins, propylene oligomer, butene oligomer or the like oligomers; alkyl succinic anhydrides obtained by hydrogenating the foregoing alkenyl succinic anhydrides; and aralkyl and aralkenyl succinic anhydrides derived from olefin compounds having an aromatic ring. More specifically, the substituted succinic anhydrides used according to the present invention include octenyl succinic anhydride, nonenyl succinic anhydride, dodecyl succinic anhydride, dodecenyl succinic anhydride, pentadecenyl succinic anhydride, pentadecyl succinic anhydride, hexadecenyl succinic anhydride, octadecenyl succinic anhydride, (1-octyl-2-decenyl)-succinic anhydride, (1-hexyl-2-octenyl)-succinic anhydride, and addition reaction products of: butene oligomers and maleic anhydride; propylene oligomers and maleic anhydride;

and butadiene oligomers or their partially-hydrogenated products and maleic anhydride.

Further, the present invention encompasses the use of an anhydrous homogeneous liquid mixture of a liquid substituted succinic anhydride and an auxiliarly dispersing agent comprising an oil-in-water type surfactant instead of the aforementioned liquid substituted succinic anhydride. As such oil-in-water type surfactant, any well-known anionic, cationic, ampholytic or nonionic surfactants may be used. Amont those, preferably usable are sulfates of polyoxyethylene alkyl ethers or sulfates of polyoxyethylene alkyl aryl ethers generally represented by the following formula or mixtures thereof:

$$R—O—CH_2—CH_2—O—_nSO_3M$$

where: R is an alkyl or alkyl aryl group having 8 or more carbon atoms and M represents H, Na, K or $NH_4$ with n representing an integer equal to or greater than 2.

Since such an anhydrous liquid mixture of a liquid substituted succinic anhydride and an oil-in-water type surfactant does not contain water, it is well stable over a long period without undergoing reduction in effectiveness or loss in functions.

In the anhydrous liquid mixture of a liquid substituted succinic anhydride and oil-in-water type surfactant, the proportion of said substituted succinic anhydride to said oil-in-water type succinic anhydride may be selected as desired.

However, it is desirable to make a pretest to determine an optimum proportion depending on specific combinations of the types of substituted succinic anhydride an oil-in-water type surfactant, the type of the ampholytic acrylamide polymer added as an aqueous solution into the mixer and the viscosity of said aqueous solution as well as on the type and performance of the mixer used. Generally, it is preferred to mix about 0.5 to about 30 parts or, more preferably, about 2 to about 10 parts by weight of the oil-in-water type surfactant with 100 parts by weight of the substituted succinic anhydride.

In the method using an anhydrous liquid mixture of a liquid substituted succinic anhydride and an oil-in-water type surfactant, since the ampholytic acrylamide polymer and the oil-in-water type surfactant cooperate to disperse the substituted succinic anhydride in water, the dispersibility of the latter is remarkably improved and, therefore, a stable fine dispersion of the substituted succinic anhydride can be obtained quite easily by using a simple mixer provided with no intricate means other than a mild stirrer.

According to the present invention, the aforementioned aqueous solution of an ampholytic acrylamide polymer having both cationic and anionic groups (a) and the liquid substituted succinic anhydride or anhydrous liquid mixture of a liquid substituted succinic anhydride and an oil-in-water type surfactant (b) do not always require the addition of water (c). However, if the aqueous solution of the ampholytic acrylamide polymer (a) has a high viscosity, the water addition permit the adjustment of the viscosity and density of the emulsion produced in the mixer and thus facilitates the emulsifying operation.

The proportion of the aqueous solution of an ampholytic acrylamid polymer (a) to the liquid substitutes succinic anhydride or to the anhydrous liquid mixture of a liquid substituted succinic anhydride and an oil-in-water type surfactant (b) as being fed into the mixer may be varied appropriately on the types and viscosities of said aqueous solution (a) and of said liquid substituted anhydride or said anhydrous liquid mixture (b). However, this proportion should be selected so that the resultant aqueous dispersion have a particle size of 5μ or less or, preferably, 1μ or less. For example, if a commercially available aqueous solution of an ampholytic acrylamide polymer (such as with concentration of 10% by weight and viscosity of 300 cps at 25° C.) is used as said aqueous solution (a), it is preferable to use about 5 to about 100 parts by weight of a liquid substituted anhydride (b) per 100 parts by weight of said aqueous solution.

According to the present invention, the above-described aqueous solution of an ampholytic acrylamide polymer (a) and liquid substituted succinic anhydride or anhydrous liquid mixture of a liquid substituted succinic anhydride and an oil-in-water type surfactant (b) and, as required, water (c) are fed into a mixer continuously and at a constant metered rate each through a constant-delivery pump or a flow meter having a flow control means or through other suitable means so that a predetermined formulation can be secured. The resultant aqueous dispersion is fed also continuously and at a constant metered rate into a papermaking pulp slurry to size the same. In this sizing operation, other papermaking additives may be added as appropriate, as a matter of course. As the mixer for preparing said aqueous dispersion which is added to the papermaking pulp slurry, it is preferable to use a line mixer or Russap mixer, although common propeller mixer or various homogenizers may be used adequately.

The paper sizing process of the present invention arranged as described herein-above is widely applicable to papermaking from acidic condition using aluminum sulfate to neutral or alkaline condition in which as alkaline loading material is used.

Further, in the paper sizing process according to the present invention, the ampholytic acrylamide polymer or the ampholytic acrylamide polymer and oil-in-water type surfactant act so effectively on the substituted succinic anhydride that in the mixer the latter is dispersed homogeneously in water substantially instantaneously. The resultant homogeneous aqueous dispersion of the substituted succinic anhydride is then mixed into a separately prepared papermaking slurry for sizing the same. Therefore, since no heavy-duty emulsifing instrument is particularly required, the process according to the present invention can size paper much improvedly and economically in a commercial-scale papermaking without reducing at all the sizing effect.

In the paper sizing process of the present invention, the fine particle of the substituted succinic anhydride added to the papermaking pulp slurry are brought into close contact with the cellulose pulp by the action of the ampholytic acrylamide polymer added together therewith and the substituted succinic anhydride is coupled to hydroxide groups of the cellulose. This is also effective to secure an improved sizing.

Furthermore, according to the present invention, since the aqueous dispersion is continuously fed into and consumed in the pulp slurry tank immediately as it is prepared in the mixer, no aqueous dispersion remains in the mixer when the papermaking machine is stopped for changing the type or grade of product paper. Thus, unlike the prior art method in which the aqueous dispersion of a substituted succinic anhydride is prepared batchwise well before its addition to the pulp slurry, the method of the present invention is substantially free from such a disadvantage that the aqueous dispersion remaining in the mixer must be disposed of as waste because its effective sizing function is remarkably reduced with time. The present invention provides a great improvement not only in material economy but also in cost and labor in waste treatment and disposal.

As described previously, since the paper sizing process according to the present invention employs as an agent for dispersing substituted succinic anhydride in water an ampholytic acrylamide polymer which is far superior in dispersing effect to cationic starch which has been heretofore used as an aqueous dispersing agent for substituted succinic anhydrides, a homogeneous aqueous dispersion of finely divided substituted succinic anhydride particle can be obtained readily and quickly and, accordingly, it is significantly effective to make improvedly sized paper. Further, the paper sizing process of the present invention is substantially free from such drawbacks of the prior art methods using cationic starch as a dispersing agent that an aqueous solution of cationic starch is apt to undergo change in properties due to decomposition or deterioration and is awkward to store; it undergoes a remarkable change in viscosity and thus difficulties are encountered in securing its constant feed rate to a mixer; it accompanies an increased waste water treatment load; and it adds to slime formation which is one of the greatest problems left unsoleved in the nuetral papermaking technique.

The paper sheets sized by the process according to the present invention feature particularly a remarkably improved resistance to hot water penetration (hereinafter shall be referred to as hot water resistance). It has been revealed that paper sheets have a hot water resistance which is radically different from or indifferent of their water resistance at room temperatures represented by, for example, Cobb value at 20° C. This is exemplified by the fact that the paper sheets sized by the process according to the present invention show a hot water resistance which as shown in the following table is remarkably different from that of those sized with a commercially-available fortified rosin-type sizing agent (both of them weighing 80 g/m$^2$ and made from waste newspaper pulp), although they show almost equal Cobb values at 20° C.

| Sizing agent quantity added (%) | Alun cake quantity added (%) | Cationic PAM *1 quantity added (%) | Cobb value (20° C.) (g/cm$^2$) | Hot water *2 resistance (sec.) |
|---|---|---|---|---|
| Commercially-available rosin-type sizing agent 0.5 | 3.0 | 0 | 25.3 | 5 |
| | 0.5 | 0.1 | 30.3 | 3 |
| Sizing agent *3 of present invention 0.5 | 3.0 | 0 | 24.5 | >600 |
| | 0.5 | 0 | 28.7 | >600 |

Notes:
*1 Commercially-available fixing agent Star Gum FN (polyacylamide produced by Seiko Kagaku Kogyo Co., Ltd.)
*2 A 3 cm × 3 cm piece of paper is kept afloat backside down on pure water kept at 80° C., and the time elapsing before at least three specks appear on the upside of the base paper due to hot water penetration is measured.
*3 An aqueous emulsion composed of 0.2 part by weight of an ampholytic polyacrylamide and 1 part by weight of an addition reaction product of a propylene oligomer and maleic anhydride is used.
*4 Percentages are based on dry weight of pulp.

The hot water resistance is one of very important factors for paper sheets used for making plasterboard base paper.

Plasterboards are useful building materials constructed of cores of plaster slush prepared by kneading plaster of Paris and other admixtures in the presence of water and plaster board base paper sheets covering the opposite sides of said cores. Generally, plasterboards are manufactured by pouring such plaster slush into spaces between two base paper sheets. Thus, since in plasterboards plaster is sandwiched between two base paper sheets, the back sides or layers of the base paper sheets must have some water absorption properties as well as a good adhesiveness to plaster or plaster slush. While, the front sides or layers of base paper sheets constituting the exposed surfaces of plasterboards must have sufficient water resistance to prevent water from penetrating to such exposed surfaces during the manufacture of the plasterboards from various considerations including aetheric effects, manufacturing workability and resultant water resistance of the plasterboards.

Apart from the water resistance required for ordinary paper sheets, the exposed layers of plaster-board base paper sheets particularly require a water resistance at elevated temperatures or hot water resistance because they are subjected to hot and highly humid conditions due to during exothermic heat and drying heat in the manufacturing process.

Heretofore, fortified rosin sizing agents have been used for sizing the exposed layers of plasterboard base paper sheets. However, with such a fortified rosin sizing agent, a use of a large quantity of alum is required. Without the alum, not only a sufficient hot water resisitance cannot be secured, but the workability is greatly affected by heavy foaming in the sizing process. While, if the alum quantity added is increased, the resultant paper sheets will contain an increased inorganic salts and have a remarkably reduced adhesiveness to plaster slush.

The inventors have found out that a multilayered paper sheet obtained by sheeting together by a well-known method at least one wet web prepared from an unsized papermaking material and at least one wet web prepared from a papermaking material sized by the aforementioned process according to the present invention has such bifacial properties best-suited for plasterboard base paper that its one face (exposed layer) has an excellent hot water resistance and the opposite face (back layer) has an excellent adhesiveness to plaster slush.

Accordingly to the present invention, there are no paricular limitations on the types of material pulp used for forming the exposed and back layers of the plasterboard base paper sheets. As such materials, various pulps may be used depending on the properties desired for the resultant base paper, including waste newspaper and the like waste paper pulp, kraft pulp, semichemical pulp, sulfite pulp, ground pulp, semiground pulp, natural or synthetic fibers, and asbestos, rock wool or the like inorganic fibers.

Especially, for providing the resultant plasterboard base paper sheets with a very high hot water resistance, it is desirable to use a small amount of alum in combination with the sizing agent according to the present invention.

That is to say, by adding 0.5 to 1.5%, based on the dry weight of pulp, of alum into the pulp slurry for the surface or exposed layer and sheeting the resultant sized wet webs with unsized wet webs into a multilayered structure in a neutral or weak acidic range, it is possible to obtain even at pH5 or in a higher range a plasterboard base paper composed of surface side layers showing a very high hot water resistance and back layers showing an excellent adhesiveness to plaster slush.

In the process for producing plasterboard base paper of the present invention arranged as described herein above, the addition of selected sizing agents into the pulpmaking slurry for the surface layer sheets of the base paper permits minimization of the quantity of the alum added in combination therewith yet securing a very high hot water resistance for resultant surface layer sheets. Thus, the process of the present invention is significantly effective to provide stably and at lower cost plasterboard base paper having improved mechanical strength and weather resistance which is composed of surface-side layers having a very high hot water resistance and back layers having good water absorption properties and adhesiveness to plaster slush.

Hereinafter, the present invention will be described further in detail by the preferred examples thereof as compared with reference examples. For this, several formulations of aqueous solutions of ampholytic acrylamide polymers and aqueous dispersions of substituted succinic anhydrides are first presented to show how the ampholytic acrylamide polymers used according to the present invention are excellent in their performance to disperse the substituted succinic anhydride in water.

Preparation of aqueous solutions of ampolytic acrylamide polymers

Aqueous solution formulation 1

In a 500 cc four-necked flask, are placed 180 g of a 15% aqueous polyacrylamide solution (with viscosity of 10,000 cps at 25° C.), 60 g of water and as a quaternarizing modifier 3.6 g of an equimolar reaction product of benzyl cholride and dimethylethanolamine. After homogeniously mixing the charge for complete dissolution, an aqueous solution prepared in advance by mixing 44 g of an aqueous solution of sodium hypochlorite with 13% effective chlorine content, 5.2 g of potassium hydroxide and 55 g of water is dropped thereinto at 20° C. to 30° C. over a period of 45 minutes. During this dropping operation, the reaction system is cooled, as required, to maintain its temperature within the range from 20° C. to 30° C.

Then, after continuing the reaction for further 30 minutes, the system is neutralized to pH4.5 by adding 10% dilute hydrochloric acid thereto for completing the reaction. Consequently, and aqueous solution of ampholytic acrylamide polymer solution (I) is obtained.

The resultant aqueous acrylamide polymer solution (I) has the polymer content of 8% and viscosity of 350 cps at 25° C. A quantitative analysis by colloidal titration reveals that the polymer contains 17.2% by mol of cationic groups (primary amino groups and quaternary ammonium groups) and 5.0% by mol of anionic groups (carboxyl groups).

Aqueous solution formulation 2

In a 500 cc four-necked flask, are placed 180 g of a 15% aqueous acrylamide polymer solution (an aqueous solution of a copolymer composed of 95 mol % acrylamide and 5 mol % acrylic acid with viscosity of 9,200 cps at 25° C.), 60 g of water and as a quaternarizing modifier 5.4 g of an equimolar reaction product of benzyl chloride and dimethylethanolamine. After homogeneously mixing the charge for complete dissolution, an aqueous solution prepared in advance by mixing 65 g of an aqueous sodium hypochlorite with 13% effective chlorine content, 7.5 g of potassium hydroxide and 55 g of water is dropped thereinto at 20° C. to 30° C. over 45 minutes. During this dropping operation, the reaction system is cooled, as required, to maintain its temperature within the range between 20° C. and 30° C.

For the succeeding steps, the same procedures as those of the preceding formulation 1 are repeated to obtain an aqueous acrylamide polymer solution (II).

The resultant aqueous acrylamide polymer solution (II) has the polymer content of 8% and viscosity of 400 cps at 25° C. A quantitative analysis by colloidal titration reveals that the polymer contains 24.8% by mol of cationic groups (primary amino groups and quaternary ammonium groups) and 10.2% by mol of anionic groups (carboxyl groups).

Aqueous solution formulation 3

In a 500 cc four-necked flask, 200 g of a 6% aqueous polyacrylamide solution (with viscosity of 18,000 cps at 25° C.) is placed and heated to 70° C.–80° C. After adding 1.6 g of an 18% aqueous potassium hydroxide solution thereto, the system is maintained at that temperature for 1 hour to partially hydrolyze the polymer. Then, the charge is diluted with 80 g of water and cooled to 50° C.

Then, 3 g of 37% formalin and 4 g of 50% aqueous dimethylamine solution are added thereto, and the system is subjected to reaction at 50° C. to 60° C. for 90 minutes. Thereafter, dilute hydrochloric acid is added to adjust the pH to 4.5 for completing the reaction. Consequently, an aqueous ampholytic acrylamide polymer solution (III) is obtained.

The resultant aqueous ampholytic acrylamide polymer solution (III) has the polymer content of 5.1% and viscosity of 2,800 cps at 25° C. A quantitative analysis by colloidal titration reveals that the polymer contains 16.5 percent by mol of cationic groups (tertiary amino groups) and 9.5% by mol of anionic groups (carboxyl groups).

Aqueous solution formulation 4

In a 500 cc four-necked flask, 200 g of a 6% aqueous polyacrylamide solution (with viscosity of 18,000 cps at 25° C.) is placed and heated to 70° C.–80° C. After adding 1.6 g of a 6% aqueous potassium hydroxide solution thereto, the system is maintained at that temperature for 1 hour to partially hydrolyze the polymer. Then, the charge is diluted with 150 g of water and cooled to 50° C.

Then, 9 g of 37% formalin and 10 g of 50% aqueous dimethylamine solution are added thereto, and the system is subjected to reaction at 50° C. to 60° C. for 90 minutes. Thereafter, dilute hydrochloric acid is added to adjust the pH to 4.5 for completing the reaction. Consequently, an aqueous ampholytic acrylamide polymer solution (IV) is obtained.

The resultant aqueous ampholytic acrylamide polymer solution (IV) has the polymer content of 5.3% and viscosity of 2,460 cps at 25° C. A quantitative analysis by colloidal titration reveals that the polymer contains 48.6% by mol of cationic groups (tertiary amino groups) and 6.1% by mol of anionic groups.

Aqueous solution formulation 5

In a 500 cc four-necked flask, are placed 24 g of acrylamide monomer, 3 g of dimethylaminoethyl methacrylate, 3 g of methacrylic acid and 1.5 g of acetic acid. Then, water is added thereto in an amount required to bring the total charge weight to 280 g. After homogeniously mixing the charge of complete dissolution, the system is heated to 50° C. Then, 10 g of an aqueous solution containing 0.03 g of ammonium persulfate and 10 g of an aqueous solution containing 0.03 g of sodium bisulfate are added thereto to initiate polymerization. The reaction system is maintained at 60° C. to 70° C. for 2 hours. At the end of the reaction, an aqueous ampholytic acrylamide polymer solution (V) is obtained.

The resultant aqueous ampholytic acrylamide polymer solution (V) has the polymer content of 10.5% and viscosity of 15,000 cps at 25° C. A quantitative analysis by colloidal titration reveals that the polymer contains 4.9% by mol of cationic groups (tertiary amino groups) and 8.9% by mol of anionic groups.

Aqueous solution formulations 6 through 8

Except that acrylamide, dimethylaminoethyl methacrylate, methacrylic acid and acetic acid are used in accordance with the respective formulations given in Table 1, the same procedures and conditions as those of the preceding formulation 5 are repeated. Consequently, are obtained aqueous ampholytic acrylamide polymer colutions (VI), (VII) and cationic acrylamide polymer (VIII) for reference purpose.

The polymer contents and viscosities of these resultant aqueous solutions are also shown in Table 1, respectively, together with the ion contents of the respective polymers.

TABLE 1

| Aqueous solution fomulation No. | Monomer content (g/mol %) AM | DM | MAA | Acetic acid content (g) | Ion content of polymer (mol %) Cationic groups | Anionic groups | Properties of aqueous acrylamide-type polymer solutions No. | Polymer content | Viscosity (cps/25° C.) |
|---|---|---|---|---|---|---|---|---|---|
| 6 | 26/92.3 | 3/4.8 | 1/2.9 | 1.5 | 4.8 | 3.5 | VI | 10.6 | 12,000 |
| 7 | 21/80.2 | 6/10.3 | 3/9.5 | 3.0 | 10.2 | 11.1 | VII | 10.3 | 9,800 |
| 8 | 20/81.5 | 10/18.5 | 0/0 | 5.0 | 18/5 | 0 | VIII | 10.0 | 10,500 |

Note:
AM . . . acrylamide
DM . . . dimethylaminoethyl methacrylate
MAA . . . methacrylic acid Aqueous solution formulation 9

In a 500 cc four-necked flask, are placed 28 g of acrylamide monomer, 3 g of acrylic acid and 22 g of a 10% aqueous potassium hydroxide solution. Then, water is added thereto in an amount required to bring the total charge weight to 280 g. After homogeneously mixing the charge, the system is heated to 50° C. Then, 10 g of an aqueous solution containing 0.1 g of ammonium persulfate and 10 g of an aqueous solution containing 0.1 g of sodium bisulfite are added thereto to initiate polymerization. The system is maintained at 60° C. to 70° C. for 2 hours. At the end of the reaction, is obtained an aqueous solution of an anionic acrylamide-type polymer (IX).

The resultant aqueous anionic acrylamide polymer solution (IX) has the polymer content of 10.3% and viscosity of 9,000 cps at 25° C. Its polymer contains 9.6% by mol of anionic groups.

Preparation of aqueous dispersions of substituted succinic anhydrides

Dispersion formulation 1

In a 200 cc beaker, the aqueous ampholytic acrylamide polymer solution (I) obtained in the aforementioned aqueous solution formulation 1 is placed in an amount equivalent to 2.5 g of the polymer and diluted with water to the total charge weight of 95 g. After adding 5 g of dodecenyl succinic anhydride thereto, the charge is agitated for 90 seconds for homogeneous emulsification by means of a testing homomixer (TK Homomixer HVM Type manufactured by Tokushuki Kako K.K., Japan) operated at 9,000 rpm. Consequently, is obtained an aqueous dispersion (a) in which dodecenyl succinic anhydride is dispersed in an aqueous medium in the presence of the ampholytic acrylamid polymer.

The resultant aqueous dispersion (a) has a good stability with its dispersed particle having the average particle size of 0.1 to 1.0$\mu$.

Dispersion formulation 2

Except for using instead of the dodecenyl succinic anhydride an alkenyl succinic anhydride which is an addition reaction product of propylene oligomers (a mixture of pentamer, hexamer and heptamer) and maleic anhydride, the same procedures and conditions as those of the preceding dispersion formulation 1 were repeated to obtain an aqueous dispersion of the alkenyl succinic anhydride (b).

The resultant aqueous dispersion of the alkenyl succinic anhydride has a good stability with its dispersed particle having the average particle size of 0.1 to 1.0$\mu$, as shown in Table 2.

Dispersion formulation 3 through 8

The same procedures and conditions as those of the preceding dispersion formulation 2 are repeated except for using the aqueous ampholytic acrylamide polymer solutions (II) through (VII) prepared in the foregoing aqueous solution formulations 2 through 7, respectively, instead of the aqueous solution (I). Consequently, are obtained aqueous dispersions of the alkenyl succinic anhydride (c) through (h), respectively, the properties of which are shown in Table 2.

Reference dispersion formulation 1

The same procedures and conditions as those of the foregoing dispersion formulation 2 are repeated except for using instead of the aqueous solution (I) the reference aqueous cationic acrylamide polymer solution (VIII) prepared in the foregoing aqueous solution formulation 8. Consequently, a reference aqueous dispersion of the alkenyl succinic anhydride (i) is obtained, the properties of which are also shown in Table 1.

Reference dispersion formulation 2

The same procedures and conditions as those of the foregoing dispersion formulation 2 are repeated except for using instead of the aqueous solution (I) the reference aqueous anionic acrylamide polymer (IX) prepared in the foregoing aqueous solution formulation 9. However, the alkenyl succinic anhydride is not emulsified in the resultant dispersion according to this formulation.

Reference dispersion formulation 3

First, 5 g of a commercially-available cationic starch (trade name: CATO-F, produced by Oji National Co., Ltd., Japan) is dissolved under heating in 185 g of water to obtain its aqueous solution. Then, the same procedures and conditions are repeated except for using, instead of the aqueous ampholytic acrylamide polymer solution (I), 95 g of said aqueous solution of the cationic starch. Consequently, is obtained a reference aqueous dispersion of the alkenyl succinic anhydride (j), the properties of which are shown also in Table 2.

TABLE 2

| | Dispersing agent; aqueous acrylamide polymer solution | Properties of aqueous dispersion | | | |
|---|---|---|---|---|---|
| | | | Particle size (μ) | | |
| | | Aqueous dispersion | Max. | Average | Stability |
| Dispersion formulation | | | | | |
| 2 | I | b | 3 | 0.1–1 | Good |
| 3 | II | c | 3 | 0.1–1 | Good |
| 4 | III | d | 3 | 0.1–1 | Good |
| 5 | IV | e | 2 | 0.1–1 | Good |
| 6 | V | f | 3 | 0.1–1 | Good |
| 7 | VI | g | 5 | 0.3–1.5 | Good |
| 8 | VII | h | 2 | 0.1–1 | Good |
| Reference dispersion formulation | | | | | |
| 1 | VIII | i | 10 | 1–10 | Unacceptable |
| 2 | IX | Emulsification impossible | | | |
| 3 | Cationic Starch | j | 15 | 1–5 | Unacceptable |

Note:
In the stability column, dispersions evaluated as "Good" show only a slight agglomeration, while "unacceptable" dispersion show somewhat poor stability with some agglomeration and separation of particle.

As is obvious from the foregoing description, the ampholytic acrylamide polymers are superior to cationic starch, anionic or cationic acrylamide polymers in their performance to disperse a substituted succinic anhydride in water.

PREFERRED EXAMPLE 1

As the aforementioned aqueous solution of an ampholytic acrylamide polymer having both cationic and anionic groups according to the present invention, is used as aqueous solution of an ampholytic acrylamide polymer which is a Hofmann degradation product of an acrylamide polymer (trade name: Star Gum AD-X, produced by Seiko Kagaku Kogyo Co., Ltd., Japan, with 10 wt.% polymer content, viscosity of 300 cps/25° C., containing 20 mol% of cationic groups and 5 mol% of anionic groups).

While, as the liquid substituted succinic anhydride, is used an addition product of maleic anhydride and propylene oligomer mainly composed of propylene pentamer.

The aqueous ampholytic acrylamide polymer solution and the liquid substituted succinic anhydride are fed continuously from their tanks each through a constant-delivery pump into a mixer (trade name: T. K. Homomick Line Flow Model 100, manufactured by Tokushu Kika Kogyo K.K., Japan) at a fed rate of 30 l/h for the aqueous solution and 6 Kg/h for the liquid substituted succinic anhydride.

The aqueous dispersion (with average particle size of about 1μ, max. particle size of about 3μ and substituted succinic anhydride content of about 16.6% by weight) discharged from the mixer is diluted with water to one-tenth through a continuous diluting machine and immediately (L/N=8/2 BKP. csf 400 cc) continuously in the chest of a Fourdrinier paper machine to size the same. The aqueous dispersion is fed at a constant rate equivalent to 0.3% by weight of the substituted succinic anhydride based on the dry weight of pulp.

The resultant paper sheet weighs 65 g/m$^2$ and has the Stöckigt sizing degree of 33 seconds.

PREFERRED EXAMPLE 2

As the aqueous solution of an ampholytic acrylamide polymer, is used an aqueous solution of an ampholytic acrylamide polymer which is a Mannich reaction product of an acrylamide polymer (trade name: Pearl Frock FR-X, produced by Seiko Kagaku Kogyo Co., Ltd., Japan; with 5 wt.% polymer content, viscosity of 3,000 cps/25° C., containing 17 mol % of cationic groups and 10 mol % of anionic groups).

While, as the liquid substituted succinic anhydride, is used the same compound as one used in the preceding Example 1.

By using the aqueous ampholytic polyacrylamide polymer solution and the liquid substituted succinic anhydride, the same mixing and sizing operations as those of the Example 1 are repeated.

In this example, the aqueous dispersion discharged from the mixer has the average particle size of about 1μ, max. particle size of about 3μ and substituted succinic anhydride content of about 16.6% by weight.

The resultant paper sheet weighs 65 g/m$^2$ and has the Stöckigt sizing degree of 32 seconds.

PREFERRED EXAMPLE 3

As the aqueous ampholytic acrylamide polymer solution, is used an aqueous solution of a three-component copolymer composed of 86% by mol of acrylamide, 9% by mol of methacrylic acid and 5% by mol of dimethylaminoethyl acrylate (with 10 wt.% polymer content and viscosity of 7,500 cps/25° C.).

While, as the liquid substituted succinic anhydride, is used the same compound as one used in the foregoing Example 1.

By using the aqueous ampholytic acrylamide polymer solution and the liquid substituted succinic anhydride, the same mixing and sizing operations as those of the Example 1 are repeated.

In this example, the aqueous dispersion discharged from the mixer has the average particle size of about 1μ, max. particle size of about 3μ and substituted succinic anhydride content of about 16.6% by weight.

The resultant paper sheet weighs 65 g/m$^2$ and has the Stöckigt sizing degree of 32 seconds.

PREFERRED EXAMPLE 4

As the aqueous ampholytic acrylamide polymer solution, is used the same aqueous solution as that used in the foregoing example 1.

While, as the aforementioned anhydrous liquid mixture of a liquid substituted succinic anhydride and an oil-in-water type surfactant, is used a homogeneous liquid mixture of 5 parts by weight of a sulfate of polyoxyethylene alkyl ether (trade name: Hitenol 18, produced by Dai-ichi Kogyo Seiyaku Co., Ltd.) and 100 parts by weight of an addition reaction product of maleic anhydride and propylene oligomer mainly composed of propylene pentamer.

The aqueous ampholytic acrylamide polymer solution and the anhydrous liquid mixture of the liquid substituted succinic anhydride and oil-in-water type surfactant are continuously fed from their tanks each through a constant-delivery pump into a mixer (Russapp mixer) at a feed rate of 30 l/h for the aqueous solution and 6.3 kg/h for the anhydrous liquid mixture. Simultaneously, water was fed thereto under high pressure at 20 l/min.

The aqueous dispersion (with average particle size of 0.5 to 1$\mu$, max. particle size of about 3$\mu$ and substituted succinic anhydride content of about 0.48% by weight) discharged from the mixer is immediately added to the pulp slurry (L/N=8/2 BKP, CSF 350 cc) in the chest of Fourdrinier paper machine to size the same. The aqueous dispersion is fed at a constant rate equivalent to 0.3% by weight of the substituted succinic anhydride based on the dry weight of pulp.

The resultant paper sheet weighs 65 g/m$^2$ and has the stöckigt sizing degree of 39 seconds.

PREFERRED EXAMPLE 5

As the aqueous ampholytic acrylamide polymer solution, is used the same aqueous solution as that used in the foregoing Example 1.

While, as the anhydrous liquid mixture of a liquid substituted succinic anhydride and oil-in-water type surfactant, is used the same homogeneous mixture as that used in the preceding Example 4.

By using the aqueous ampholytic acrylamide polymer solution and the homogeneous anhydride liquid mixture, the same mixing and sizing operations as those of the preceding Example 4 are repeated.

In this example, the aqueous dispersion discharged from the mixer has the average particle size of about 1$\mu$, max. particle size of about 3$\mu$ and substituted succinic anhydride content of about 0.48% by weight. The resultant paper sheet weighs 65 g/cm$^2$ and Stöckigt sizing degree of 37 seconds.

REFERENCE EXAMPLE 1

Except for using an aqueous solution of a commercially-available cationic starch (trade name: CATO-F, produced by Oji National Co., Ltd.,; containing 5% by weight of the starch with viscosity of 410 cps/25° C.) instead of the aqueous ampholytic acrylamide polymer solution, the same mixing and sizing operations as those of the foregoing Example 1 are repeated.

In this example, the aqueous dispersion discharged from the mixer has the average particle size of about 3$\mu$, max. particle size of about 10$\mu$ and substituted succinic anhydride content of about 16.6% by weight.

The resultant paper sheet weighs 65 g/cm$^2$ and has the Stöckigt sizing degree of 24 seconds.

PREFERRED EXAMPLE 8

This example illustrates a process for making plasterboard base paper of multilayered structure sized according to the present invention.

The same aqueous ampholytic acrylamide polymer solution and liquid substituted succinic anhydride as those used in the foregoing Example 1 are fed continuously from their tanks each through a constant-delivery pump into a mixer (trade name: T. K. Homomick Line Flow Model 100, manufactured by Tokushu Kika Kogyo K.K., Japan) at a feed rate of 45 l/h for the aqueous solution and 9 kg/h for the liquid substituted succinic anhydride.

The aqueous dispersion discharged from the mixer is diluted with water to one-tenth through a continuous diluting machine and immediately fed continuously into the first, second and third-layer machine chests of a 5-layer Ultra Homer type paper machine containing a pulp slurry (waste newspaper pulp CSF 200 cc) to size the same. The aqueous dispersion is fed at a constant rate equivalent to 0.3% by weight of the substituted succinic anhydride based on the dry weight of pulp. Simultaneously, 0.5% by weight of alum based on the dry weight of pulp is added to the machine chest contents.

The pulp slurries in the fourth and fifth layer chests are not subjected to sizing.

To the respective layer pulp slurries, 0.02% by weight of a commercially-available water filtration accelerator (trade name: Star Gum FN, produced by Seiko Kagaku Kogyo Co., Ltd.) based on the dry weight of pulp is added at the feed side of the respective layer screens.

The resultant plasterboard base paper of 5-layer structure weighs 220 g/m$^2$ and composed of the first, second and third layers sized according to the present invention and the unsized fourth and fifth layers.

When tested by the method described herein below, this plasterboard base paper made according to the present invention shows a hot water resistance for 10 to 15 minutes, for 13 minutes on the average, which is far improved over the prior art plasterboard base paper using a fortified rosin type sizing agent (with 0.5 wt.% fortified rosin content and 3 wt. % alum content based on the pulp), of which the hot water resistance ranges from about 5 to 8 minutes, 6 minutes and 30 seconds on the average.

Further, plasterboards formed by using the plasterboard base paper made according to the present invention have a very good adhesiveness between the plaster and base paper.

Hot water resistance test

A 3 cm×3 cm piece of paper is kept afloar backside down on pure water kept at 80° C., and the time elapsing before at least three specks appear on the upside of the base paper due to hot water penetration is measured.

What is claimed is:

1. A process for sizing paper comprising:

(o) forming an aqueous solution of ampholytic acrylamide polymer having both a cationic group and an anionic group, (i) feeding into a mixer continuously and at a constant metered rate (a) said aqueous solution of an ampholytic acrylamide polymer defining a dispersing agent and having about 2–80 mol.% cationic and about 3–20 mol.% anionic groups, (b) a liquid substituted succinic anhydride; and (ii) adding said aqueous dispersion into a papermaking pulp slurry continuously and at a constant metered rate immediately after said dispersion is prepared in said mixer.

2. The process for sizing paper according to the preceding claim 1, wherein said ampholytic acrylamide polymer contains 3 to 50% by mol of cationic groups and 3 to 15% by mol of anionic groups.

3. The process for sizing paper according to the preceding claim 1 or 2, wherein said ampholytic acrylamide polymer comprises a Hofmann degradation product of an acrylamide polymer.

4. The process for sizing paper according to the foregoing claim 1 or 2, wherein said ampholytic acrylamid polymer comprises a Mannich reaction product of an acrylamide polymer.

5. The process for sizing paper according to the foregoing claim 1 or 2, wherein said ampholytic acrylamide polymer comprises a three-component copolymer composed of acrylamide or methacrylamide, acrylic acid or methacrylic acid and dialkylaminoalkyl acrylate or methacrylate.

6. The process for sizing paper according to the foregoing claim 1, wherein said liquid substituted succinic anhydride comprises a substituted succinic anhydride which has an alkenyl or alkyl group having 8 or more carbon atoms.

7. A process for sizing paper comprising:

(o) forming an aqueous solution of ampholytic acrylamide polymer having both a cationic group and an anionic group, (i) feeding into a mixer continuously and at a constant metered rate (a) said aqueous solution of an ampholytic acrylamide polymer having about 2–80 mol.% cationic and about 3–20 mol.% anionic groups to form a dispersing agent, (b) an anhydrous liquid mixture of a liquid substituted succinic anhydride and an oil-in-water type surfactant and (ii) adding said aqueous dispersion into a papermaking pulp slurry continuously and at a constant metered rate immediately after said dispersion is prepared in the mixer.

8. The process for sizing paper according to the preceding claim 7, wherein said ampholytic acrylamide polymer contains 3 to 50% by mol of cationic groups and 3 to 15% by mol of anionic groups.

9. The process for sizing paper according to the preceding claim 7 or 8, wherein said ampholytic acrylamide polymer comprises a Hofmann decomposition product of an acrylamide polymer.

10. The process for sizing paper according to the foregoing claim 7 or 8, wherein said ampholytic acrylamide polymer comprises a Mannich reaction product of an acrylamide polymer.

11. The process for sizing paper according to the foregoing claim 7 or 8, wherein said ampholytic acrylamide polymer comprises a three-component copolymer composed of acrylamide or methacrylamide, acrylic acid or methacrylic acid and dialkylaminoalkyl acrylate or methacrylate.

12. The process for sizing paper according to the foregoing claim 7, wherein said liquid substituted succinic anhydride comprises a substituted succinic anhydride which has an alkenyl or alkyl group having 8 or more carbon atoms.

13. The process for sizing paper according to the foregoing claim 7, wherein said oil-in-water type surfactant comprises a compound to be selected out of the groups cosisting of suflates of polyoxythylene alkyl ethers and sulfates of polyoxyethylene alkyl aryl ethers generally represented by the following formula and mixtures thereof:

$$R—O—CH_2—CH_2—O—SO_3M$$

where: R is an alkyl or alkyl aryl group having 8 or more carbon atoms and M represents H, Na, K or $NH_4$ with n representing an integer equal to or greater than 2.

14. A process for making plasterboard base paper sheets of multilayered structure comprising sheeting together at least one sized wet web and at least one unsized wet web said unsized wet web being formed from an unsized papermaking material and said sized wet web being formed from a sized papermaking material, wherein said sized papermaking material is prepared by;

(o) forming an aqueous solution of ampholytic acrylamide polymer having both a cationic group and an anionic group, (i) feeding into a mixer continuously and at a constant metered rate (a) said aqueous solution of an ampholytic acrylamide polymer having about 2–80 mol.% cationic and about 3–20 mol.% anionic groups to form a dispersing agent, (b) a liquid substituted succinic anhydride and an oil-in-water type surfactant and, (ii) adding said aqueous dispersion into a papermaking pulp slurry continuously and at a constant metered rate immediately after said dispersion is prepared in said mixer.

* * * * *

UNITED STATES PATENT AND TRADEMARK OFFICE

CERTIFICATE OF CORRECTION

PATENT NO. : 4,533,434

DATED : August 6, 1985

INVENTOR(S) : SHIGEHIKO YOSHIOKA ET AL

It is certified that error appears in the above-identified patent and that said Letters Patent is hereby corrected as shown below:

Col. 3, line 10, Cancel "amont" and substitute therefore ---among---; Col. 3, line 15, Cancel "$R-O-CH_2-CH_2-O-_nSO_3M$" and substitute therefore ---$R-O(CH_2-CH_2-O)_nSO_3M$---; Col. 3, line 19, Cancel "n" and substitute therefore ---n---; Col. 3, line 34, Cancel "an" and substitute therefore ---and---; Col. 3, line 61, Cancel "permit" and substitute therefore ---permits---; Col. 4, line 6, Cancel "have" and substitute therefore ---has---; Col. 5, line 31, Cancel "unsoleved" and substitute therefore ---unsolved---; Col. 5, line 31, Cancel "nuetral" and substitute therefore ---neutral---; Col. 5, line 50, Cancel "Alun" and substitute therefore ---Alum---; Col. 7, line 31, Cancel "ampolytic" and substitute therefore ---ampholytic---; Col. 9, line 30, Cancel "colutions" and substitute therefore ---solutions---; Col. 13, line 34, Cancel "stockigt" and substitute therefore ---Stockigt---; Col. 14, line 56, Cancel "afloar" and substitute therefore ---afloat---; Claim 4, Col. 15, line 17, Cancel "acrylamid" and substitute therefore ---acrylamide---; Claim 13, Col. 16, line 21, Cancel "cosisting" and substitute therefore ---consisting---;

UNITED STATES PATENT AND TRADEMARK OFFICE

CERTIFICATE OF CORRECTION

PATENT NO. : 4,533,434

DATED : August 6, 1985

INVENTOR(S) : SHIGEHIKO YOSHIOKA ET AL

It is certified that error appears in the above-identified patent and that said Letters Patent is hereby corrected as shown below:

Claim 13, Col. 16, line 26, Cancel "$R-O-CH_2-CH_2-O-SO_3M$" and substitute therefore ---$R-O(CH_2-CH_2-O)SO_3M$---.

Signed and Sealed this

*Sixteenth* Day of *September 1986*

[SEAL]

*Attest:*

DONALD J. QUIGG

*Attesting Officer* *Commissioner of Patents and Trademarks*